United States Patent [19]

Wood et al.

[11] 4,282,671

[45] Aug. 11, 1981

[54] BOLT-ON FORE STOCK

[75] Inventors: John C. Wood, Baltimore; Charles W. Thompson, Roseneath, both of Canada

[73] Assignee: Olin Corporation, New Haven, Conn.

[21] Appl. No.: 16,222

[22] Filed: Feb. 28, 1979

[51] Int. Cl.[3] ..... F41C 23/00

[52] U.S. Cl. ..... 42/75 A; 42/75 D

[58] Field of Search ..... 42/75 D, 75 A, 75 B, 42/75 C

[56] References Cited

U.S. PATENT DOCUMENTS

| | | | |
|---|---|---|---|
| 1,173,582 | 2/1916 | Johnson | 42/75 B |
| 2,610,426 | 9/1952 | Emerson | 42/75 A |
| 3,183,618 | 5/1965 | Flewellen | 42/75 A |
| 3,444,641 | 5/1969 | Ruger | 42/75 A |

*Primary Examiner*—Charles T. Jordan

*Attorney, Agent, or Firm*—William W. Jones; Paul J. Lerner

[57] ABSTRACT

An improved means of attaching a fore stock to a break action firearm provides for convenient adjustment to compensate for dimensional variations caused by wear, or occuring during manufacture of the various firearm components, and allows the user to adjust the tightness of the action. The stock is screwed to a wedge member riding on a cammed lug carried by the firearm barrel, such that tightening of the screw causes the stock to be cammed against the receiver hinge.

4 Claims, 3 Drawing Figures

BOLT-ON FORE STOCK

BACKGROUND

The present invention relates to firearms and, more particularly, to a means for adjustably attaching a fore stock to a firearm.

It is common practice, in the design and construction of "long guns," i.e. rifles and shotguns, to include a fore arm or fore stock under at least the portion o the barrel or barrels adjacent the breech or breeches. In "break action" firearms, those having a hinged connection between the receiver and the barrel or barrels, to permit access to the chamber or chambers, the fore stock is necessarily separate from the shoulder stock. In such cases, the fore stock is frequently attached to the barrel or barrels and abuts the receiver at the hinge point. Attachment is generally accomplished by means of a spring-loaded tongue, disposed in a keyhole recess in the fore stock, which engages a notched lug depending from the barrel or barrels. The fore stock attachment means, as described, is seen to suffer several inherent limitations.

Over a period of time, the spring tends to develop a permanent set, whereby the tongue is no longer firmly urged into the lug notch. This permits an undesirable degree of movement or "play" between the fore stock and the barrel or barrels.

Further, repeated assembly and disassembly of the fore stock to the barrel or barrels tends to cause a wearing of the lug about the lower lip of the notch, enlarging the effective size of the notch and introducing further "play". Although this particular problem may be corrected by periodic replacement of the lug, such replacement is costly and inconvenient due to the fact that the lug is most commonly brazed to the barrel or barrels, whereby replacement requires the services of a skilled gunsmith.

Lastly, and most importantly, the present attachment means makes no provision for the adjustment of the axial position of the fore stock relative to the remainder of the firearm. Thus, precise and costly dimensional tolerances must be maintained, during manufacture, to insure proper mating of the fore stock and the receiver.

SUMMARY OF THE INVENTION

The above limitations are overcome by the improved attachment means of the present invention, wherein the fore stock is adjustably attached to a wedge member riding on a cammed lug carried by the firearm barrel or barrels, such that displacement of the wedge member radially of the barrel causes an axial displacement of the fore stock. More specifically, as the wedge member is drawn toward the fore stock the latter is cammed rearwardly against the receiver hinge.

The present attachment means is seen to offer the further important advantage of allowing the firearm user to adjust the force urging the fore stock into abutment with the receiver, whereby the "tightness" of the hinge may be readily controlled.

BRIEF DESCRIPTION OF THE DRAWING

The present invention may be more readily understood by reference to the following detailed description and the drawing, wherein.

DESCRIPTION OF THE PREFERRED EMBODIMENT

Figure 1:
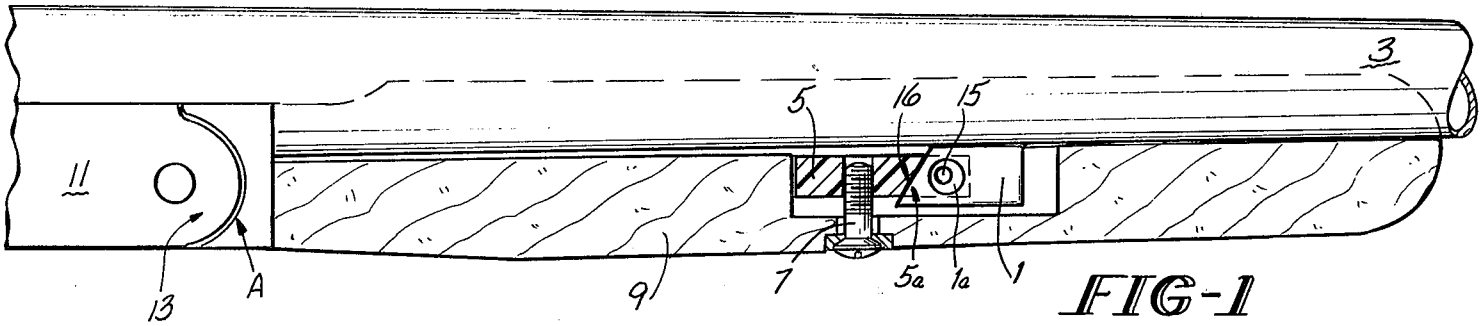
FIG. 1 is a fragmentary cross-sectional view of a firearm embodying the fore stock attachment means of the present invention, the fore stock here having a substantial amount of "play;"

As shown in the drawings, the fore stock attachment means comprises an attachment lug 1 brazed to the barrel 3, a fore stock wedge 5 co-operating with the attachment lug 1, and a screw 7 adjustably attaching the fore stock 9 to the fore stock wedge 5. The barrel 3 is connected to a receiver 11 by a hinge 13.

Figure 3:
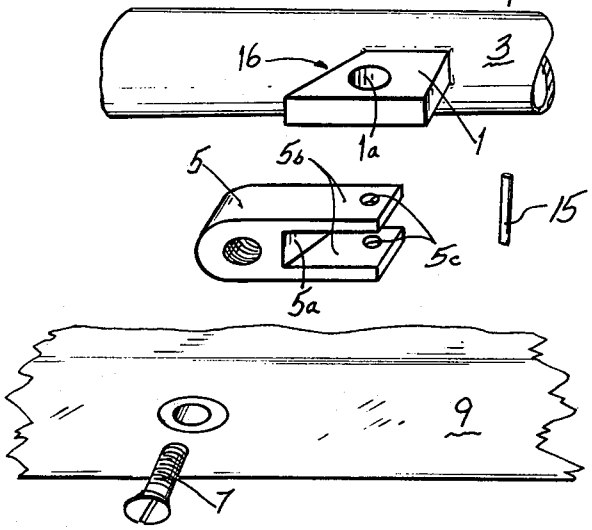
FIG. 3 is an exploded view of the fore stock attachment means of FIGS. 1 and 2.

As best seen in FIG. 3, the attachment lug 1 includes a transverse through-bore 1*a*, having a diameter substantially larger than the diameter of pin 15, and an inclined planar cam surface 16 sloping outwardly from the barrel 3 toward the receiver 11.

The fore stock wedge 5 includes an inclined planar cam surface 5*a* and a pair of parallel, projecting wings 5*b*, 5*b* pierced by concentrically disposed holes 5*c*, 5*c* sized to retainingly admit pin 15. The wedge 5 is disposed with wings 5*b*, 5*b* flanking the attachment lug 1, and is retained thereon by pin 15 passing through both the holes 5*c*, 5*c* and the through-bore 1*a*. The cam surface 5*a* slopes radially inwardly, with respect to the barrel 3, and toward the firearm muzzle (not shown) and rides on the co-operating lug cam surface 16. It will be appreciated that, due to the comparatively large diameter of through-bore 1*a*, there exists a substantial amount of "play" between fore stock wedge 5 and the attachment lug 1, the wedge 5 being secured to the lug 1 merely to prevent separation during assembly and disassembly of the firearm.

Figure 2:
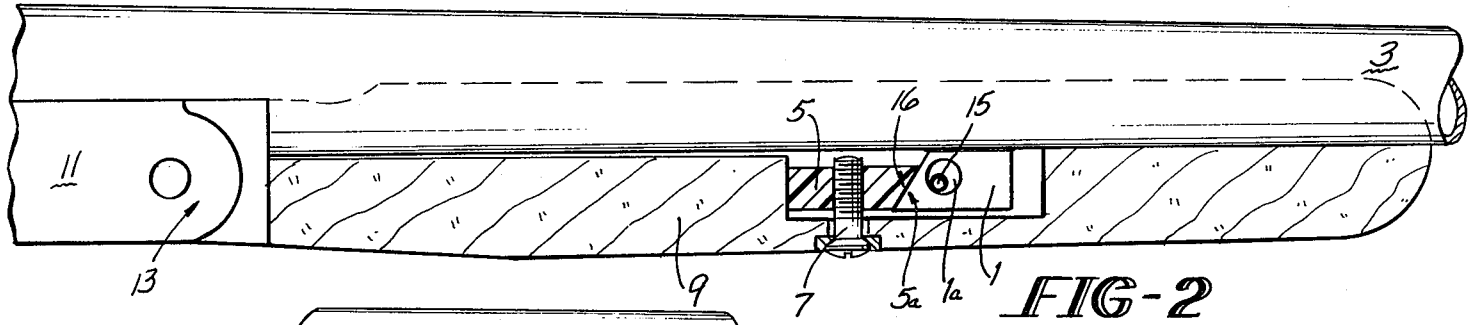
FIG. 2 is a fragmentary cross-sectional view, similar to FIG. 1, wherein the fore stock has been tightened.

With the fore stock 9 bedded beneath the barrel 3, there may occur an undesirable space A (FIG. 1) between the stock 9 and the hinge 13, resulting from wear therebetween or from dimensional tolerances introduced during manufacture. With the attachment means of the present invention, this space A may be conveniently eliminated by tightening screw 7, drawing the fore stock wedge 5 radially away from the barrel 3 and toward the fore stock 9. During this radial movement, the wedge 5 rides on the cam surface 16 of the attachment lug 1 and is thereby displaced rearwardly, i.e. toward the receiver 11, drawing with it the stock 9 (FIG. 2). Thus, by proper adjustment of the screw 7, the fore stock 9 may be made to closely abut the hinge 13. It will be readily understood that, by further adjustment of the screw 7, a desired degree of axial force may be impressed on the fore stock 9, urging the same against the hinge 13. It is thus possible for the firearm user to conveniently adjust the "tightness" of the hinge 13 and, hence, the effort required to open and close the firearm action.

While one embodiment of the invention has been shown, it is obvious that a number of changes and modifications can be made without departing from the scope and spirit thereof which are intended to be limited only by the appended claims.

We claim:

1. In a firearm having a receiver, a fore stock and at least one barrel, an improved means for adjustably attaching the fore stock to the remainder of the firearm; said means comprising: an attachment lug carried by the barrel and including a first inclined cam surface, a fore stock wedge co-operating with said attachment lug and including a second inclined cam surface, and means adjustably attaching said fore stock to said fore stock wedge so as to permit adjustment of the radial distance therebetween, said second cam surface riding on said first cam surface, such that radial displacement of said fore stock wedge, relative to said fore stock, results in a corresponding axial displacement of said fore stock relative to said lug, whereby said fore stock may be adjustably abutted against the receiver.

2. The invention of claim 1, wherein said first cam surface slopes radially outwardly from said barrel toward said receiver, and said second cam surface slopes radially inwardly toward the muzzle of the firearm.

3. The invention of claim 2, wherein said attachment means comprises a screw member connecting said fore stock and fore stock wedge, such that said rotation of said screw displaces said fore stock wedge relative to said fore stock.

4. The invention of claim 3, wherein said fore stock wedge is secured to said attachment lug to prevent separation during assembly and disassembly of the firearm.

* * * * *